US011400448B2

(12) United States Patent
Geng et al.

(10) Patent No.: US 11,400,448 B2
(45) Date of Patent: Aug. 2, 2022

(54) CHIP SUBSTRATE, FABRICATING METHOD THEREOF AND DIGITAL MICRO-FLUIDIC CHIP

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yue Geng, Beijing (CN); Peizhi Cai, Beijing (CN); Fengchun Pang, Beijing (CN); Le Gu, Beijing (CN); Chuncheng Che, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 279 days.

(21) Appl. No.: 16/610,244

(22) PCT Filed: Mar. 19, 2019

(86) PCT No.: PCT/CN2019/078659

§ 371 (c)(1),
(2) Date: Nov. 1, 2019

(87) PCT Pub. No.: WO2019/184764

PCT Pub. Date: Oct. 3, 2019

(65) Prior Publication Data

US 2020/0055050 A1 Feb. 20, 2020

(30) Foreign Application Priority Data

Mar. 26, 2018 (CN) ..... 201810251665.8

(51) Int. Cl.
*B01L 3/00* (2006.01)

(52) U.S. Cl.
CPC ... *B01L 3/502715* (2013.01); *B01L 3/502707* (2013.01); *B01L 3/502792* (2013.01);
(Continued)

(58) Field of Classification Search
CPC ..... B01L 3/502792; B01L 3/502715
See application file for complete search history.

(56) References Cited

U.S. PATENT DOCUMENTS 7,815,871 B2 10/2010 Pamula et al.
2007/0138016 A1 6/2007 Wang
(Continued)

FOREIGN PATENT DOCUMENTS

CN 101687191 A 3/2010
CN 101773814 A 7/2010
CN 103170384 A 6/2013
CN 103983794 A 8/2014
CN 104248998 A 12/2014
(Continued)

OTHER PUBLICATIONS

First Office Action dated Apr. 30, 2019 corresponding to Chinese application No. 201810251665.8.
(Continued)

*Primary Examiner* — Brian J. Sines
(74) *Attorney, Agent, or Firm* — Nath, Goldberg & Meyer; Joshua B. Goldberg

(57) ABSTRACT

The disclosure provides a chip substrate and a digital micro-fluidic chip and belongs to the field of digital micro-fluidic technology. The chip substrate provided by the disclosure has a plurality of control regions spaced apart from each other, the chip substrate including: a first base substrate; a driving electrode disposed in each control region over the first base substrate, the driving electrode being configured to drive a droplet to move, wherein the chip substrate further comprises a pressure detecting element provided in each control region over the first base substrate, and configured to detect a pressure from the droplet, so that the chip substrate determines a position of the droplet according to the pressure.

20 Claims, 4 Drawing Sheets

(52) U.S. Cl.
CPC ..... *B01L 2200/12* (2013.01); *B01L 2300/06* (2013.01); *B01L 2300/0645* (2013.01); *B01L 2300/0883* (2013.01); *B01L 2300/12* (2013.01); *B01L 2300/165* (2013.01); *B01L 2400/0415* (2013.01)

(56) References Cited

U.S. PATENT DOCUMENTS

| | | | | |
|---|---|---|---|---|
| 2013/0134040 | A1 | 5/2013 | Lee et al. | |
| 2013/0164856 | A1* | 6/2013 | Jebrail ..... | B01L 3/502784 436/86 |
| 2016/0296934 | A1 | 10/2016 | Dong et al. | |

FOREIGN PATENT DOCUMENTS

| | | | |
|---|---|---|---|
| CN | 104588137 | A | 5/2015 |
| CN | 105413765 | A | 3/2016 |
| CN | 205528801 | U | 8/2016 |
| CN | 107037903 | A | 8/2017 |
| CN | 107583692 | A | 1/2018 |
| CN | 107754962 | A | 3/2018 |
| CN | 107790203 | A | 3/2018 |
| CN | 108355728 | A | 8/2018 |
| JP | 9-213212 | A | 8/1997 |

OTHER PUBLICATIONS

Second Office Action dated Sep. 27, 2019 corresponding to Chinese application No. 201810251665.8.

* cited by examiner

CHIP SUBSTRATE, FABRICATING METHOD THEREOF AND DIGITAL MICRO-FLUIDIC CHIP

CROSS-REFERENCE TO RELATED APPLICATION

This is a National Phase Application filed under 35 U.S.C. 371 as a national stage of PCT/CN2019/078659, filed on Mar. 19, 2019, an application claiming the benefit of priority to Chinese Patent Application No. 201810251665.8 filed on Mar. 26, 2018 in the National Intellectual Property Administration, PRC, the contents of which are incorporated herein in their entirety by reference.

TECHNICAL FIELD

The present disclosure belongs to the field of droplet-based digital micro-fluidic technology, and particularly relates to a chip substrate, a fabricating method thereof and a digital micro-fluidic chip.

BACKGROUND

Droplets can be driven to move accurately by using the digital micro-fluidic technology, thereby realizing operations such as fusion and separation of the droplets, and completing various biochemical reactions. Compared with the conventional micro-fluidic technology, the digital micro-fluidic technology can be used for accurately operating the liquid in units of one droplet and finishing the target reaction with less amount of reagent, and therefore more accurately controlling the reaction rate and the reaction progress. Therefore, the digital micro-fluidic technology has excellent development prospect in the field of biological detection. With the development of human biochemistry and medical technology, requirements for the detection of biomolecules become more various, and the limitation on the reaction conditions of the biological detection is more accurate.

SUMMARY

The present disclosure provides a chip substrate for a digital micro-fluidic chip, the chip substrate having a plurality of control regions spaced apart from each other, the chip substrate including: a first base substrate; a driving electrode in each of the control regions over the first base substrate, the driving electrode being configured to drive a droplet to move, wherein the chip substrate further includes: a pressure detecting element in each of the control regions over the first base substrate, and configured to detect a pressure from the droplet, such that the chip substrate determines a position of the droplet according to the pressure.

According to an embodiment of the present disclosure, the pressure detecting element includes a force sensitive resistor, the driving electrode has an opening, and the force sensitive resistor is in the opening and electrically coupled to the driving electrode.

According to an embodiment of the present disclosure, the force sensitive resistor includes a plurality of first resistance bars spaced apart from each other in a first direction and extending in a second direction perpendicular to the first direction, and a plurality of second resistance bars spaced apart from each other in the second direction and extending in the first direction, each of the plurality of second resistance bars connecting the spaced first resistance bars, to form a "square waveform" pattern.

According to an embodiment of the present disclosure, the driving electrode has four openings including a first opening and a second opening opposite to each other and a third opening and a fourth opening opposite to each other, and the first opening, the second opening, the third opening, and the fourth opening are in a peripheral region of the driving electrode.

According to an embodiment of the present disclosure, the pressure detecting element includes four force sensitive resistors, and each of the first opening, the second opening, the third opening, and the fourth opening is provided therein with a corresponding one of the force sensitive resistors having the "square waveform" pattern.

According to an embodiment of the present disclosure, an extending direction of the force sensitive resistor in the first opening is the same as an extending direction of the force sensitive resistor in the second opening, an extending direction of the force sensitive resistor in the third opening is the same as an extending direction of the force sensitive resistor in the fourth opening, and the extending directions of the force sensitive resistors in the first opening and the third opening are perpendicular to each other. In each of the force sensitive resistors, an extending direction of each of the first resistor bars is perpendicular to the extending direction of the force sensitive resistor, and each of the first resistance bars has a length greater than that of each of the second resistance bars.

According to an embodiment of the present disclosure, a first support layer and a second support layer between the first base substrate and the driving electrode are in each of the plurality of control regions, the first support layer being closer to the first base substrate than the second support layer; the first support layer is provided therein with a groove covered by the second support layer; orthographic projections of the first opening, the second opening, the third opening and the fourth opening on the first base substrate at least partially overlap with an orthographic projection of an edge of the groove on the first base substrate.

According to an embodiment of the present disclosure, the chip substrate further includes: a first dielectric layer on a side of the driving electrode and the force sensitive resistor away from the first base substrate and between adjacent ones of the control regions; and a first hydrophobic layer on a side of the first dielectric layer away from the first base substrate.

According to an embodiment of the present disclosure, the pressure detecting element further includes: a voltage detecting element coupled to both ends of the driving electrode and configured to obtain a voltage signal according to a change of resistance value of the force sensitive resistor.

According to an embodiment of the present disclosure, the voltage detecting element includes a Wheatstone bridge, the force sensitive resistor serves as one resistor in the Wheatstone bridge, and the Wheatstone bridge is configured to measure the voltage signal caused by the force sensitive resistor.

According to an embodiment of the present disclosure, the pressure detecting element includes a pressure sensor configured to detect the pressure from the droplet and convert the pressure into a voltage signal, the driving electrode has an opening therein, and the pressure sensor is in the opening and electrically coupled to the driving electrode.

According to an embodiment of the present disclosure, the chip substrate further includes a first processor configured to determine the position of the droplet from the voltage signal obtained by the pressure detecting element.

The present disclosure provides a digital micro-fluidic chip including the chip substrate according to the embodiments of the present disclosure and a second substrate arranged opposite to and aligned with the chip substrate, wherein the driving electrode drives the droplet to move based on a control voltage applied between the driving electrode in the chip substrate and a reference electrode in the second substrate.

According to an embodiment of the present disclosure, the second substrate further includes: a second base substrate on the reference electrode; a second dielectric layer on a side of the reference electrode away from the second base substrate; and a second hydrophobic layer on a side of the second dielectric layer away from the second base substrate.

According to an embodiment of the present disclosure, the chip substrate further includes a second processor configured to process the voltage signal obtained by the pressure detecting element to output the control voltage for driving the droplet in a corresponding one of the control regions to move.

The present disclosure provides a method for fabricating a chip substrate, including: forming a cavity on a base substrate; forming a plurality of driving electrodes spaced apart from each other over the base substrate to define a plurality of control regions; forming a force sensitive resistor in each of the control regions over the base substrate; and sequentially forming a dielectric layer and a hydrophobic layer over the base substrate, wherein the driving electrodes and the force sensitive resistors are located in a same layer, and the driving electrode and the force sensitive resistor in each of the control regions are electrically coupled with each other.

DETAILED DESCRIPTION

In order to enable a person skilled in the art to better understand the technical solutions of the present disclosure, the present disclosure is described in further detail below with reference to the accompanying drawings and specific embodiments.

The existing digital micro-fluidic chip only has a function of driving a droplet, but cannot monitor position and moving path of the droplet, that is, in an actual experimental process, the digital micro-fluidic chip cannot confirm whether the movement of the droplet is according to a preset path, and for some reactions with complex moving paths, final experimental products or experimental results are inevitably influenced once phenomena such as the droplet stagnating occur, which is disadvantageous for the application and promotion of digital micro-fluidic products and micro-fluidic technologies in complex biochemical reactions.

Figure 1:
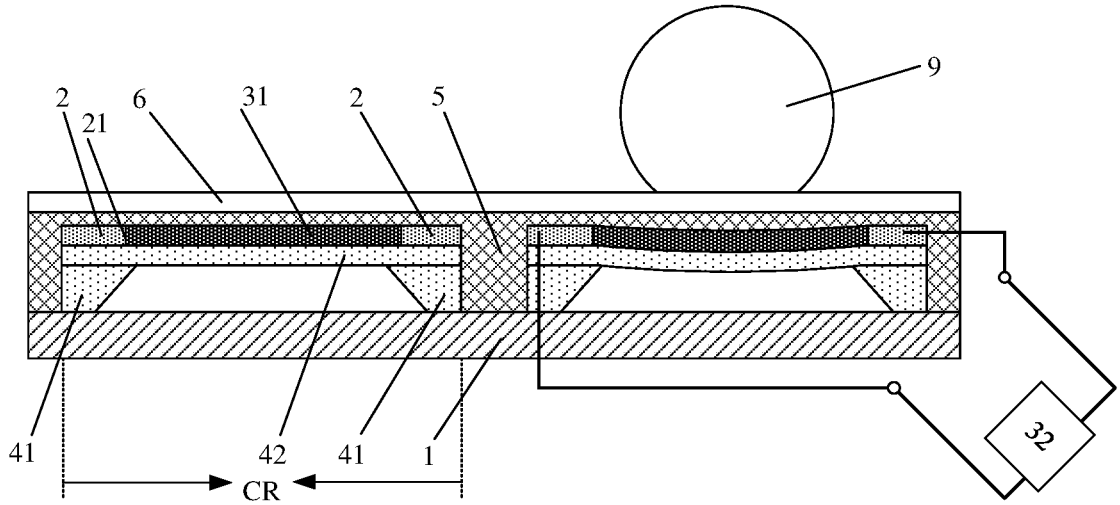
FIG. 1 is a schematic diagram illustrating a cross-section of a chip substrate taken in a thickness direction according to an embodiment of the present disclosure.
Figure 2:
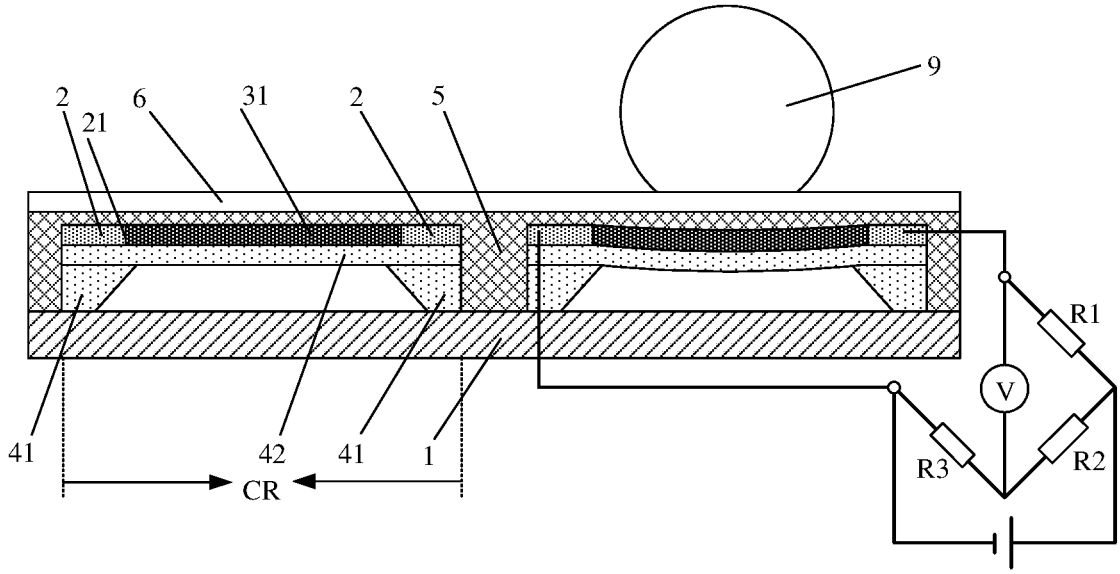
FIG. 2 is a schematic diagram illustrating a cross-section of a chip substrate taken in a thickness direction according to an example embodiment of the present disclosure.
Figure 3:
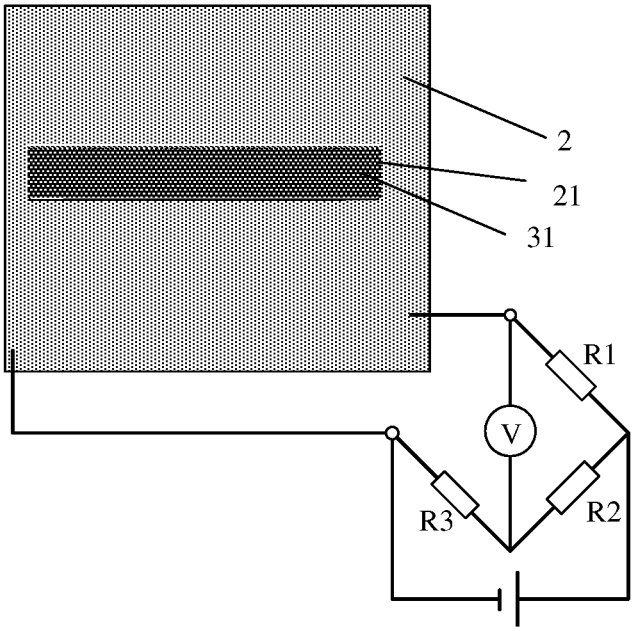
FIG. 3 is a schematic diagram of a layout of a driving electrode and a pressure detecting element of a chip substrate according to an embodiment of the present disclosure.

As shown in FIG. 1 and FIG. 2, an embodiment of the present disclosure provides a chip substrate, which can be used in a digital micro-fluidic chip to drive a droplet 9 to move, so as to implement operations such as fusion and separation of the droplet 9 to complete various biochemical reactions.

The chip substrate has a plurality of control regions CR spaced apart from each other, and includes: a base substrate 1 and driving electrodes 2 respectively disposed in the control regions CR over the base substrate 1. The driving electrode 2 is configured to drive the droplet 9 to move. When the chip substrate is applied to the digital micro-fluidic chip, respective electrical signals are applied between the driving electrodes 2 and a reference electrode 8 (see FIG. 5) arranged opposite to the driving electrodes 2. The droplet 9 is subjected to an unbalanced stress due to an electric field between the driving electrode 2 and the reference electrode 8, so that the droplet 9 moves on the chip substrate from one control region to another control region, thereby achieving the driving of the droplet 9. In particular, in the present embodiment, the chip substrate further includes in each control region CR: a pressure detecting element 3 provided over the base substrate 1, and configured to detect a pressure from the droplet 9 such that the chip substrate determines a position of the droplet 9 according to the pressure.

The droplet 9, whether in a static state or a moving state on the chip substrate, may cause the pressure on the chip substrate (i.e., cause the pressure on the pressure detecting element 3 over the base substrate 1). In this embodiment, the pressure detecting element 3 is disposed in each control region, detects the pressure of the droplet 9 on the chip substrate, and converts the pressure into an electrical signal, so that which control region the droplet 9 is currently located in (that is, the position and the moving path of the droplet 9) can be determined according to the changes of the electrical signals in respective control regions, thereby precisely controlling the subsequent movement of the droplet 9.

According to an embodiment of the present disclosure, the pressure detecting element 3 may include a force sensitive resistor 31 for sensing the pressure and a Wheatstone bridge 32 for converting a value of the pressure into the electrical signal (e.g., a voltage signal). Alternatively, the pressure detecting element 3 may include a pressure sensor for sensing the pressure and for converting the value of the pressure into the electrical signal.

It will be appreciated that the force sensitive resistor 31 is a particular element that converts mechanical force into an electrical signal, and that its resistance value can vary with the magnitude of the force applied thereto.

The following description will be made by taking a case in which the pressure detecting element 3 includes the force sensitive resistor 31 and the Wheatstone bridge 32 an example.

According to an embodiment of the present disclosure, the driving electrode 2 has an opening 21, and the force sensitive resistor 31 of the pressure detecting element 3 is disposed in the opening 21 and electrically coupled to the driving electrode 2. That is, in the present embodiment, the driving electrode 2 and the force sensitive resistor 31 are disposed in the same layer, and electrically coupled to each other. The expression "disposed in the same layer" herein means that, in the chip substrate, the driving electrode 2 and the force sensitive resistor 31 are located in the same level. It will be appreciated that an area occupied by the driving electrode 2 in the control region may be as large as possible, and the driving electrode 2 may be as close as possible to the position where the chip substrate contacts the droplet 9, so as to ensure the driving effect on the droplet 9. Since the pressure of the droplet 9 on the chip substrate may be relatively small, the position of the force sensitive resistor 31 may also be as close as possible to the position where the chip substrate contacts the droplet 9. Therefore, in this embodiment, the force sensitive resistor 31 may be disposed in the opening 21 of the driving electrode 2, and the force sensitive resistor 31 and the driving electrode 2 may be disposed in the same layer and electrically coupled with each other, such that, in a driving stage for the droplet 9, the force sensitive resistor 31 may also serve as a part of the driving electrode 2 to ensure the driving effect on the droplet 9, and in a detecting stage for the droplet 9, the driving electrode 2 may also serve as a part of a wiring (or a resistor) of a detection circuit, which will not have an influence on the detection of the position of the droplet 9.

Specifically, as shown in FIG. 2, the driving electrode 2 in the control region CR is a block-shaped driving electrode sheet, and may be formed of a conductive material such as aluminum (Al), copper (Cu), Indium Tin Oxide (ITO), or the like. In the present embodiment, one or more openings 21 may be formed in the driving electrode sheet by a patterning process such as etching, and the force sensitive resistor 31 electrically coupled to the driving electrode 2 is disposed in the opening 21.

Figure 4:
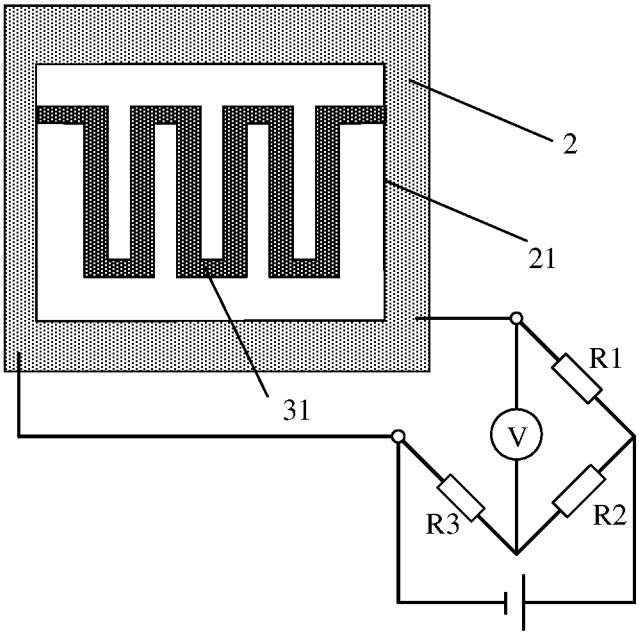
FIG. 4 is a schematic diagram of a layout of a driving electrode and a pressure detecting element of a chip substrate according to another embodiment of the present disclosure.

According to an embodiment of the present disclosure, referring to FIG. 4, each driving electrode 2 may include one opening 21, and the force sensitive resistor 31 disposed in the opening 21 includes a plurality of first resistance bars spaced apart from each other in a first direction and extending in a second direction perpendicular to the first direction, and a plurality of second resistance bars spaced apart from each other in the second direction and extending in the first direction, each of the plurality of second resistance bars connecting the spaced first resistance bars to form a "square waveform" pattern, thereby increasing the deformation amount of the force sensitive resistor and making the detection more accurate.

Figure 5:
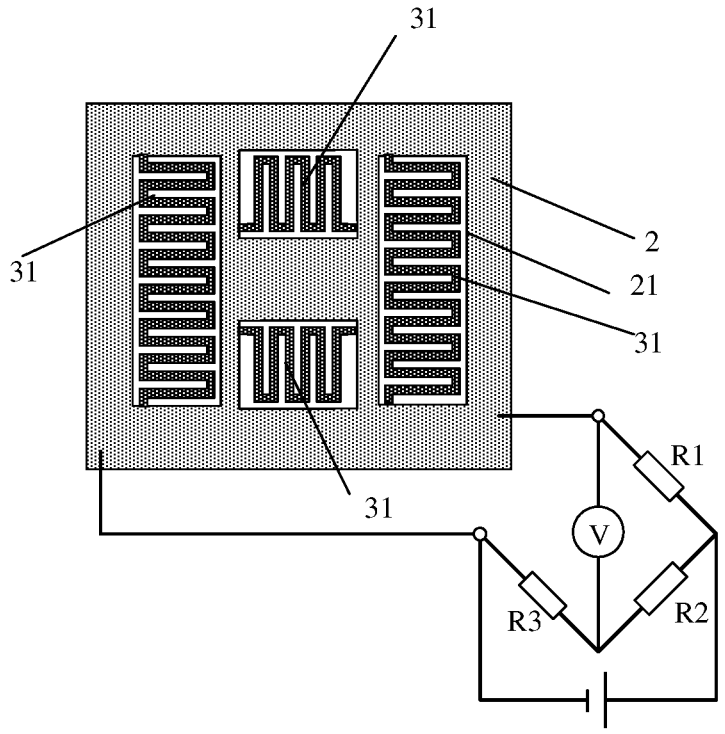
FIG. 5 is a schematic diagram of a layout of a driving electrode and a pressure detecting element of a chip substrate according to yet another embodiment of the present disclosure.

According to another embodiment of the present disclosure, the driving electrode 2 has four openings 21 including a first opening and a second opening opposite to the first opening and a third opening and a fourth opening opposite to the third opening, and the first opening, the second opening, the third opening, and the fourth opening are in the peripheral region of the driving electrode 2. As shown in FIG. 5, the driving electrode 2 covers most area of the control region CR, the peripheral region of the driving electrode 2 is provided with four openings surrounding a central region of the driving electrode 2, and the force sensitive resistor 31 is disposed in each opening.

Specifically, force sensitive resistors are respectively disposed in the first opening, the second opening, the third opening and the fourth opening. In the embodiment, the force sensitive resistor may include a resistive strain gauge, such as a metal strain gauge. When the droplet 9 is located in the control region, it will apply a pressure to the force sensitive resistor and the driving electrode 2 thereunder, and the deformation is obvious due to the fact that the force sensitive resistor is located in the peripheral region of the driving electrode 2, so that detection is more accurate.

Further, the extending directions of the force sensitive resistors in the first opening and the second opening are the same, the extending directions of the force sensitive resistors in the third opening and the fourth opening are the same, and the extending direction of the force sensitive resistors in the first opening is perpendicular to that of the third opening. In each force sensitive resistor, the extending direction of the first resistor bars is perpendicular to the extending direction of the force sensitive resistor, and the length of each of the first resistance bars is greater than the length of each of the second resistance bars. When the droplet 9 is over the control region, the force sensitive resistor in the peripheral region within the control region may deform in a direction from the peripheral region toward the central region of the control region. As shown in FIG. 5, in the embodiment, by the arrangement described above, the extending direction of most of the first resistance bars of the four force sensitive resistors is approximate to the direction from the peripheral region toward the central region of the control region, so that the total deformation of the force sensitive resistors is more obvious. Furthermore, the length of each of the first resistance bars is greater than that of each of the second resistance bars, so that the area of the first resistance bars in the resistive strain gauge with unit area is larger than that of the second resistance bars, the total amount of deformation of the resistive strain gauge is relatively large, and the detection precision of pressure is improved.

According to an embodiment of the present disclosure, in the case where the pressure detecting element 3 includes a pressure sensor, the pressure sensor may be disposed in the opening 21 of the driving electrode 2.

According to an embodiment of the present disclosure, the chip substrate further includes, in each control region, a first support layer 41 and a second support layer 42 between the base substrate 1 and the driving electrode 2, the first support layer 41 being closer to the base substrate 1 than the second support layer 42. The first support layer 41 is provided with a groove therein, and the second support layer 42 covers the groove. Orthographic projections of the first, second, third and fourth openings on the base substrate 1 at least partially overlap an orthographic projection of the groove on the base substrate 1.

When the droplet 9 is on the chip substrate, the force sensitive resistor where the droplet 9 is located is deformed due to pressure, and thus resistance of the force sensitive resistor changes. Correspondingly, in the present embodiment, a cavity is formed below the force sensitive resistor (on a side of the force sensitive resistor close to the base substrate 1) by using the second support layer 42 and the first support layer 41 with the groove, and the projections of the cavity and the force sensitive resistor on the base substrate 1 at least partially overlap, so that the cavity can be used to adapt to the deformation of the force sensitive resistor caused by the pressure. When the cavity is deformed under pressure, the deformation amount of an edge of the cavity is the largest, and thus, in the embodiment, the projections of the four openings on the base substrate 1 overlap with the projection of the edge of the cavity on the base substrate 1, so that the deformation of the force sensitive resistor is more obvious. The material of the first support layer 41 and the second support layer 42 may be silicon, and both of the first support layer 41 and the second support layer 42 may be formed by using bulk micromachining and surface micromachining processes of silicon.

The chip substrate may further include: a dielectric layer 5 and a hydrophobic layer 6 on a side of the driving electrode 2 away from the base substrate 1. The driving electrodes 2 in different control regions are separated by the dielectric layer 5. The hydrophobic layer 6 is on a side of the dielectric layer 5 away from the base substrate 1 for making the droplet 9 move more smoothly.

Specifically, the dielectric layer 5 may cover upper surfaces of the force sensitive resistor 31, the driving electrode 2, and the base substrate 1, and side surfaces of the driving electrode 2, the first support layer 41, and the second support layer 42.

According to an embodiment of the present disclosure, the electrical signal is a voltage signal. The chip substrate further includes: a plurality of voltage detecting elements 32 respectively coupled to both ends of each of the plurality of driving electrodes and configured to obtain the voltage signal according to a change of the resistance value of the force sensitive resistor.

Specifically, the voltage detecting element 32 may include a Wheatstone bridge. As shown in FIGS. 2 to 5, the force sensitive resistor 31 can be coupled to the voltage detecting element 32 as a variable resistor to form a Wheatstone bridge together with a first resistor R1, a second resistor R2 and a third resistor R3. When there is no droplet 9 in the control region, the bridge is balanced, and an output signal V is zero. When there is a droplet 9 in the control region, the pressure detecting element 3 is pressed to cause a change in resistance, the bridge is unbalanced, and the output signal V is changed. Thus, it is possible to determine from the output signal of the Wheatstone bridge which control region the droplet 9 is located in, thereby determining the position of the droplet 9.

The embodiment provides a chip substrate for the digital micro-fluidic chip, and the chip substrate includes a plurality of control regions each provided with a pressure detecting element 3. The pressure detecting element 3 can convert the pressure of the droplet 9 on the base substrate 1 into the electrical signal, so that which control region the droplet 9 currently is located in can be determined according to the change of the electrical signal in each control region, thereby carrying out accurate control to the subsequent movement of the droplet 9. In addition, the pressure detecting element 3 (specifically, the force sensitive resistor 31 or the pressure sensor) in the present embodiment may be disposed in the same layer as the driving electrode 2, and may have electrical connection with the driving electrode 2, such that the pressure detecting element 3 may serve as the driving electrode 2 in the driving stage for the droplet 9, and the driving electrode 2 may serve as the resistor of the detecting circuit in the detecting stage for the droplet 9, so that the pressure detecting effect is improved as much as possible without affecting the driving function.

Figure 6:
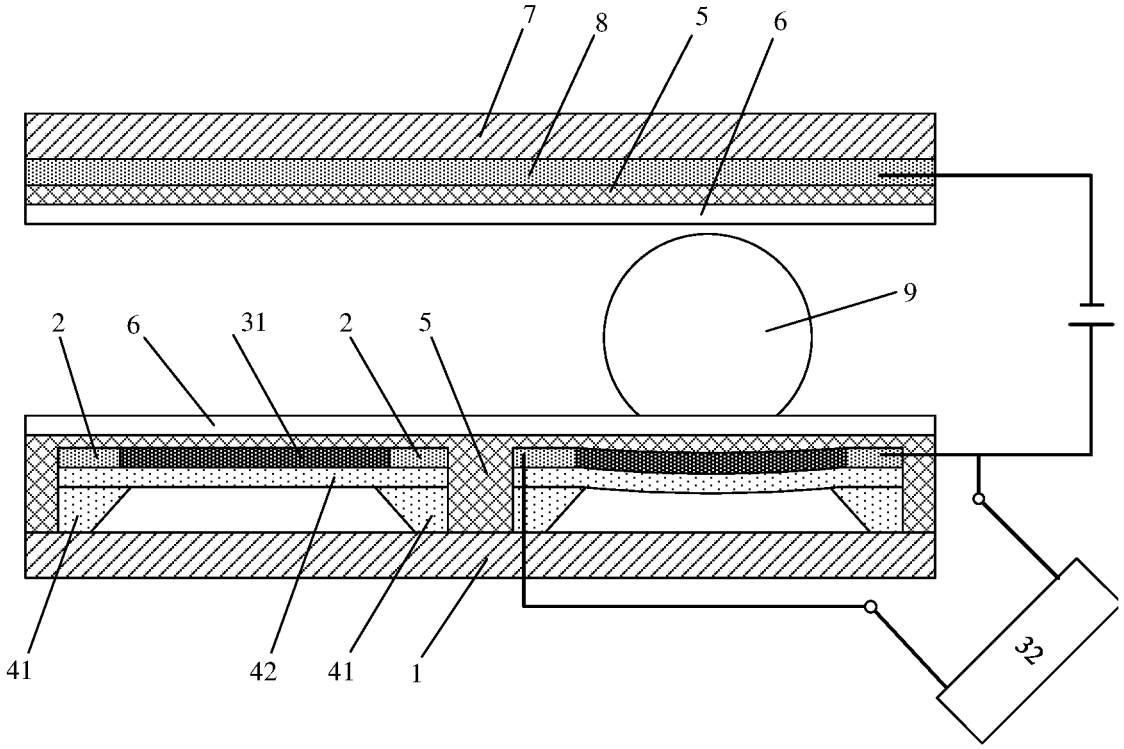
FIG. 6 is a schematic diagram of a cross-section of a digital micro-fluidic chip taken in a thickness direction according to an embodiment of the present disclosure.

As shown in FIG. 6, the present embodiment provides a digital micro-fluidic chip, including: any chip substrate (i.e., a first chip substrate) provided in the above embodiments, and a second substrate opposite to the first chip substrate. A space for accommodating the droplet 9 is formed between the second substrate and the first chip substrate. The second substrate includes a second base substrate 7, and a reference electrode 8, a dielectric layer 5 and a hydrophobic layer 6 are sequentially arranged on a side of the second base substrate 7 facing the first chip substrate. The digital micro-fluidic chip may further include a driving circuit coupled to the reference electrode 8 and the driving electrode 2, and capable of driving the movement of the droplet 9 by inputting control signals to the reference electrode 8 and the driving electrode 2.

In an embodiment, the digital micro-fluidic chip further includes: a processor, configured to determine the position of the droplet 9 according to the voltage signal detected by the voltage detecting element, analyze and determine the moving path of the droplet 9 according to a change of the position of the droplet 9, and control the driving circuit according to a preset path of the droplet 9 to determine a next control signal of the driving circuit so as to accurately drive the droplet 9 to move. In particular, the processor may be used as the driving circuit. For example, in the case where the pressure detecting element includes the force sensitive resistor 31 and the voltage detecting element, the processor may be provided in the voltage detecting element 32. In the case where the pressure detecting element includes a pressure sensor, the processor may be provided separately and coupled between an output terminal of the pressure sensor and an input terminal of the driving electrode. The processor is configured to process the voltage signal output by the voltage detecting element or the pressure sensor to output the control voltage for driving the movement of the droplet in the control region, thereby driving the droplet to move.

Alternatively, the processor may include a first processor configured to determine the position of the droplet from the voltage signal detected by the pressure detecting element, and a second processor configured to process the voltage signal output by the voltage detecting element or the pressure sensor to output the control voltage for driving the movement of the droplet in the control region, thereby driving the droplet to move.

The digital micro-fluidic chip of the present embodiment includes a plurality of control regions, and a detecting circuit (e.g., a pressure detecting element) and a driving circuit (e.g., a processor) corresponding to each control region. The operation of the digital micro-fluidic chip can be divided into the driving stage for the droplet 9 and the detecting stage for the droplet 9. During the driving stage for the droplet 9, control signals are input from the driving circuit to the reference electrode 8 and the driving electrode 2 (alternatively, the control signal may be input to only the driving electrode 2 and the reference electrode 8 may be grounded) to drive the movement of the droplet 9. During the detecting stage for the droplet 9, the detecting circuit in the control region where the droplet 9 is located outputs the electrical signal, and the processor determines the position of the droplet 9 according to the electrical signal. Meanwhile, the processor may drive the droplet 9 to move according to a preset path based on the determined position, so that the droplet 9 can be precisely controlled, and the precise operation of biological detection reaction is facilitated.

Figure 7:
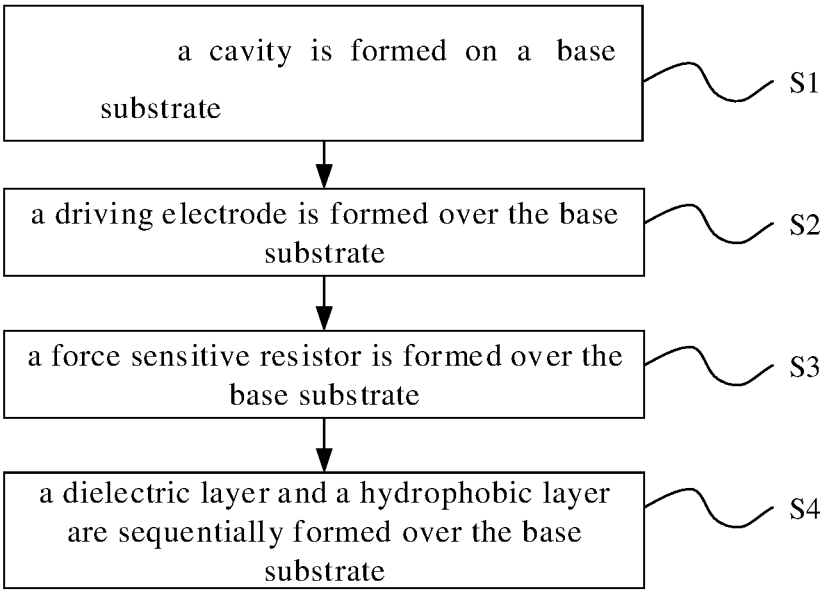
FIG. 7 is a flowchart of a method for fabricating a chip substrate according to an embodiment of the disclosure.

As shown in FIG. 7, the embodiment provides a method for fabricating a chip substrate for a digital micro-fluidic chip, and the method can be used to fabricate the chip substrate provided in the above embodiments.

The chip substrate includes a base substrate including a plurality of control regions, and a driving electrode and a pressure detecting element 3 are provided in each control region. Specifically, in the present embodiment, the following description will be made by taking the case where the driving electrode and the pressure detecting element 3 are provided in the same layer, and the pressure detecting element includes a force sensitive resistor as an example.

The fabricating method includes steps S1-S4.

In step S1, a cavity is formed on a base substrate.

Specifically, a first support layer and a second support layer are formed on a base substrate by bulk micromachining and surface micromachining processes of silicon, the second support layer being on a side of the first support layer away from the base substrate, a plurality of grooves being disposed on a side of the first support layer close to the second support layer, and the first support layer and the second support layer are assembled to form a plurality of cavities. Each control region is provided with a corresponding one of the cavities. The base substrate may be a silicon base substrate.

In step S2, a driving electrode is formed over the base substrate.

Specifically, a conductive film layer is formed over the base substrate by physical sputtering, chemical vapor deposition, or the like, and a pattern of the driving electrode is formed in each control region by a patterning process (e.g., film formation, exposure, development, wet etching, or dry etching). The material of the driving electrode may be aluminum (Al), copper (Cu), Indium Tin Oxide (ITO), etc.

Openings are provided in the pattern of the driving electrode to enable subsequently-formed force sensitive resistor to be in the same layer with the driving electrode.

In step S3, a force sensitive resistor is formed over the base substrate.

Specifically, the force sensitive resistor may be a metal strain gauge. Similarly to forming the driving electrode, in this step, a metal film layer may be formed over the base substrate by sputtering, chemical vapor deposition, or the like, and the pattern of the metal strain gauge may be formed by a patterning process. The metal strain gauge is in the opening of the driving electrode so as to be in the same layer as the driving electrode and realize the electrical coupling between the force sensitive resistor and the driving electrode in the same control region.

In step S4, a dielectric layer and a hydrophobic layer are sequentially formed over the base substrate.

The dielectric layer may be formed by physical sputtering, chemical vapor deposition, or the like, and the hydrophobic layer may be formed by spin coating or the like.

Finally, the fabrication of the chip substrate for the digital micro-fluidic chip is completed.

In an embodiment, the embodiment may further include a method for fabricating a second substrate. The second substrate is arranged opposite to and aligned with the formed chip substrate, and the second substrate and the formed chip substrate are assembled to form the digital micro-fluidic chip. The second substrate includes a second base substrate, a reference electrode, a dielectric layer, and a hydrophobic layer. The second base substrate may be a glass substrate. In the method for fabricating the second substrate, the fabricating steps of each structure can refer to the above content, and details thereof will not be described herein.

The embodiment provides a method of fabricating a chip substrate for a digital micro-fluidic chip, and the chip substrate fabricated by the method includes a plurality of control regions each provided with a pressure detecting element 3. The pressure detecting element 3 can convert the pressure of the droplet 9 on the base substrate 1 into the electrical signal, so that which control region the droplet 9 currently is located in can be determined according to the change of the electrical signal in each control region, thereby carrying out accurate control to the subsequent movement of the droplet 9. In addition, the pressure detecting element 3 in the present embodiment may be disposed in the same layer as the driving electrode 2, and may have electrical connection with the driving electrode 2, such that the pressure detecting element 3 may serve as the driving electrode 2 in the driving stage for the droplet 9, and the driving electrode 2 may serve as the resistor of the detecting circuit in the detecting stage for the droplet 9, so that the pressure detecting effect is improved as much as possible without affecting the driving function.

It is to be understood that the above embodiments are merely exemplary embodiments to explain the principles of the present disclosure, and the present disclosure is not limited thereto. Various modifications and improvements may be made by those skilled in the art without departing from the spirit and scope of the disclosure, and are also considered to be within the scope of the disclosure.

The invention claimed is:

1. A chip substrate for a digital micro-fluidic chip, the chip substrate having a plurality of control regions spaced apart from each other, the chip substrate comprising:

a first base substrate;

a driving electrode in each of the control regions over the first base substrate, the driving electrode being configured to drive a droplet to move, wherein the chip substrate further comprises a pressure detecting element in each of the control regions over the first base substrate, and configured to detect a pressure from the droplet, such that the chip substrate determines a position of the droplet according to the pressure.

2. The chip substrate of claim 1, wherein the pressure detecting element comprises a force sensitive resistor, and the driving electrode has an opening, the force sensitive resistor being in the opening and electrically coupled to the driving electrode.

3. The chip substrate of claim 2, wherein the force sensitive resistor comprises a plurality of first resistance bars spaced apart from each other in a first direction and extending in a second direction perpendicular to the first direction, and a plurality of second resistance bars spaced apart from each other in the second direction and extending in the first direction, each of the plurality of second resistance bars connecting the spaced first resistance bars, to form a "square waveform" pattern.

4. The chip substrate of claim 2, wherein the driving electrode has four openings comprising a first opening and a second opening opposite to each other, and a third opening and a fourth opening opposite to each other, and the first opening, the second opening, the third opening, and the fourth opening are in a peripheral region of the driving electrode.

5. The chip substrate of claim 3, wherein the driving electrode has four openings comprising a first opening and a second opening opposite to each other, and a third opening and a fourth opening opposite to each other, and the first opening, the second opening, the third opening, and the fourth opening are in a peripheral region of the driving electrode.

6. The chip substrate of claim 5, wherein the pressure detecting element comprises four force sensitive resistors, and each of the first opening, the second opening, the third opening, and the fourth opening is provided therein with a corresponding one of the force sensitive resistors having the "square waveform" pattern.

7. The chip substrate of claim 6, wherein an extending direction of the force sensitive resistor in the first opening is the same as an extending direction of the force sensitive resistor in the second opening, an extending direction of the force sensitive resistors in the third opening is the same as an extending direction of the force sensitive resistor in the fourth opening, and the extending directions of the force sensitive resistors in the first opening and the third opening are perpendicular to each other, and in each of the force sensitive resistors, an extending direction of the first resistor bars is perpendicular to the extending direction of the force sensitive resistor, and each of the first resistance bars has a length greater than that of each of the second resistance bars.

8. The chip substrate of claim 5, wherein a first support layer and a second support layer between the first base substrate and the driving electrode are in each of the plurality of control regions, the first support layer being closer to the first base substrate than the second support layer, the first support layer being provided therein with a groove covered by the second support layer, and orthographic projections of the first opening, the second opening, the third opening and the fourth opening on the first base substrate at least partially overlap with an orthographic projection of an edge of the groove on the first base substrate.

9. The chip substrate of claim 2, further comprising:

a first dielectric layer on a side of the driving electrode and the force sensitive resistor away from the first base substrate and between adjacent ones of the control regions; and a first hydrophobic layer on a side of the first dielectric layer away from the first base substrate.

10. The chip substrate of claim 2, wherein the pressure detecting element further comprises: a voltage detecting element coupled to both ends of the driving electrode and configured to obtain a voltage signal according to a change of resistance value of the force sensitive resistor.

11. The chip substrate of claim 10, wherein the voltage detecting element comprises a Wheatstone bridge, the force sensitive resistor serves as one resistor in the Wheatstone bridge, and the Wheatstone bridge is configured to measure the voltage signal caused by the force sensitive resistor.

12. The chip substrate of claim 1, wherein the pressure detecting element comprises a pressure sensor configured to detect the pressure from the droplet and convert the pressure into a voltage signal, and the driving electrode has an opening therein, and the pressure sensor is in the opening and electrically coupled to the driving electrode.

13. The chip substrate of claim 10, further comprising a first processor configured to determine the position of the droplet from the voltage signal obtained by the pressure detecting element.

14. The chip substrate of claim 12, further comprising a first processor configured to determine the position of the droplet from the voltage signal obtained by the pressure detecting element.

15. A digital micro-fluidic chip, comprising the chip substrate of claim 1 and a second substrate arranged opposite to and aligned with the chip substrate, wherein the driving electrode drives the droplet to move based on a control voltage applied between the driving electrode in the chip substrate and a reference electrode in the second substrate.

16. A digital micro-fluidic chip, comprising the chip substrate of claim 2 and a second substrate arranged opposite to and aligned with the chip substrate, wherein the driving electrode drives the droplet to move based on a control voltage applied between the driving electrode in the chip substrate and a reference electrode in the second substrate.

17. A digital micro-fluidic chip, comprising the chip substrate of claim 3 and a second substrate arranged opposite to and aligned with the chip substrate, wherein the driving electrode drives the droplet to move based on a control voltage applied between the driving electrode in the chip substrate and a reference electrode in the second substrate.

18. The digital micro-fluidic chip of claim 15, wherein the second substrate further comprises:

a second base substrate on the reference electrode, a second dielectric layer on a side of the reference electrode away from the second base substrate, and a second hydrophobic layer on a side of the second dielectric layer away from the second base substrate.

19. The digital micro-fluidic chip of claim 15, wherein the chip substrate further comprises a second processor configured to process the voltage signal obtained by the pressure detecting element to output the control voltage for driving the droplet in a corresponding one of the control regions to move.

20. A method for fabricating a chip substrate, comprising:

forming a cavity on a base substrate;

forming a plurality of driving electrodes spaced apart from each other over the base substrate to define a plurality of control regions;

forming a force sensitive resistor in each of the control regions over the base substrate; and sequentially forming a dielectric layer and a hydrophobic layer over the base substrate, wherein the driving electrodes and the force sensitive resistors are located in a same layer, and the driving electrode and the force sensitive resistor in each of the control regions are electrically coupled with each other.

* * * * *